US005668445A

United States Patent [19]

Matsui

[11] Patent Number: 5,668,445

[45] Date of Patent: Sep. 16, 1997

[54] ELECTRONIC FLASH APPARATUS WITH CONSTANT DURATION REPEATED FLASH

[75] Inventor: Hideki Matsui, Fujisawa, Japan

[73] Assignee: Nikon Corporation, Tokyo, Japan

[21] Appl. No.: 736,242

[22] Filed: Oct. 24, 1996

Related U.S. Application Data

[63] Continuation of Ser. No. 533,212, Sep. 22, 1995, abandoned, which is a continuation of Ser. No. 365,184, Dec. 28, 1994, abandoned, which is a continuation of Ser. No. 147,538, Nov. 5, 1993, abandoned.

[30] Foreign Application Priority Data

Nov. 10, 1992 [JP] Japan ..... 4-077393 U

[51] Int. Cl.[6] ..... H05B 41/14

[52] U.S. Cl. ..... 315/241 P; 315/241 S

[58] Field of Search ..... 315/241 P, 241 S, 315/241 R, 151, 307, DIG. 7; 354/413, 416, 145.1, 127.1, 414

[56] References Cited

U.S. PATENT DOCUMENTS

| | | | |
|---|---|---|---|
| 3,687,029 | 8/1972 | Leczkowski | 354/414 |
| 3,716,752 | 2/1973 | Iwata | 315/151 |
| 3,822,393 | 7/1974 | Karpol | 315/241 P |
| 5,250,977 | 10/1993 | Tanaka | 315/241 P X |

*Primary Examiner*—Ali Neyzari

[57] ABSTRACT

An electronic flash apparatus having: a condenser; a flash tube which is connected with said condenser and flashes when electricity stored in the condenser is discharged; and a flash operation control device for performing drive control of said flash tube so that the flash tube flashes repeatedly when electricity stored in said condenser is applied to the flash tube.

The flash operation control circuit varies the luminous amount of each of the repeated flashes of the flash tube according to the voltage accumulated in the condenser.

3 Claims, 2 Drawing Sheets

ELECTRONIC FLASH APPARATUS WITH CONSTANT DURATION REPEATED FLASH

This application is a continuation of application Ser. No. 08/533,212, filed Sep. 22, 1995, now abandoned which is a continuation of Ser. No. 08/365,184, filed Dec. 28, 1994, now abandoned, which is continuation of Ser. No. 08/147,538 filed Nov. 5, 1993, now abandoned.

BACKGROUND OF THE INVENTION

1. Field of the Invention

The present invention relates to an electronic flash apparatus for repeatedly flashing.

2. Related Background Art

An electric flash apparatus has been known which repeatedly flashes by rapidly and repeatedly discharging electricity stored in a condensor to a flash tube during one exposure operation of a camera. The luminous amount of each of the repeated flashes has been determined independently of the voltage accumulated in the condenser.

Generally, in said electronic flash apparatus, a ready-light is turned on when the voltage accumulated in the condenser reaches a predetermined value in order to inform the user that the condenser is charged with said predetermined voltage (the ready-light-ON voltage). This ready-light-ON voltage is fixed to a constant voltage, whether repetitive flash operation is carried out or normal flash operation (single flash operation) is performed.

The above-mentioned ready-light-ON voltage is generally set to be lower than the full-charge voltage. In case of single flash operation, if the single flash operation is fully executed immediately after the ready light is turned on, the luminous amount decreases by only about 1 EV in comparison with the luminous amount in case of single flash operation fully executed after the accumulated voltage reaches the full-charge voltage. The decrease is within an allowable range with respect to photographic sensitivity of film, and accordingly, does not cause any trouble to the photographer.

In case of repetitive flash operation, however, if the operation is executed immediately after the ready light is turned on, duration of the repetitive flash operation becomes shorter than the duration of repetitive operation executed after the accumulated voltage reaches the full-charge voltage. For, in said case, the accumulated voltage is lower than the full-charge voltage, when the flash operation can not be performed at the end of the duration thereof.

SUMMARY OF THE INVENTION

The object of the present invention is to secure the predetermined duration of the flash operation with ready-light-ON voltage set to be lower than the full-charge voltage, even if repetitive flash operation is executed immediately after the ready light is turned on.

The electronic flash apparatus according to the present invention comprises: a condenser; a flash tube which is connected with the condenser and flashes when electricity stored in the condenser is discharged and applied to the flash tube; and a flash operation control circuit for performing drive control of the flash tube so that the electricity stored in the condensor and applied to the flash tube makes the flash tube flash repeatedly, wherein said flash operation control circuit varies the luminous amount of each of the repeated flashes of the flash tube according to the voltage accumulated in the condenser.

In the electronic flash apparatus having the above-mentioned constitution, the luminous amount of each of the repeated flashes of the flash tube is determined by the flash operation control circuit which varies the luminous amount of each of the repeated flashes according to the voltage accumulated in the condenser. Therefore, said problematic change of duration of the flash operation, which is caused by change of the voltage accumulated in the condenser, can be avoided.

DESCRIPTION OF THE PREFERRED EMBODIMENT

A preferred embodiment according to the present invention will be described below with reference to the drawings.

Figure 1:
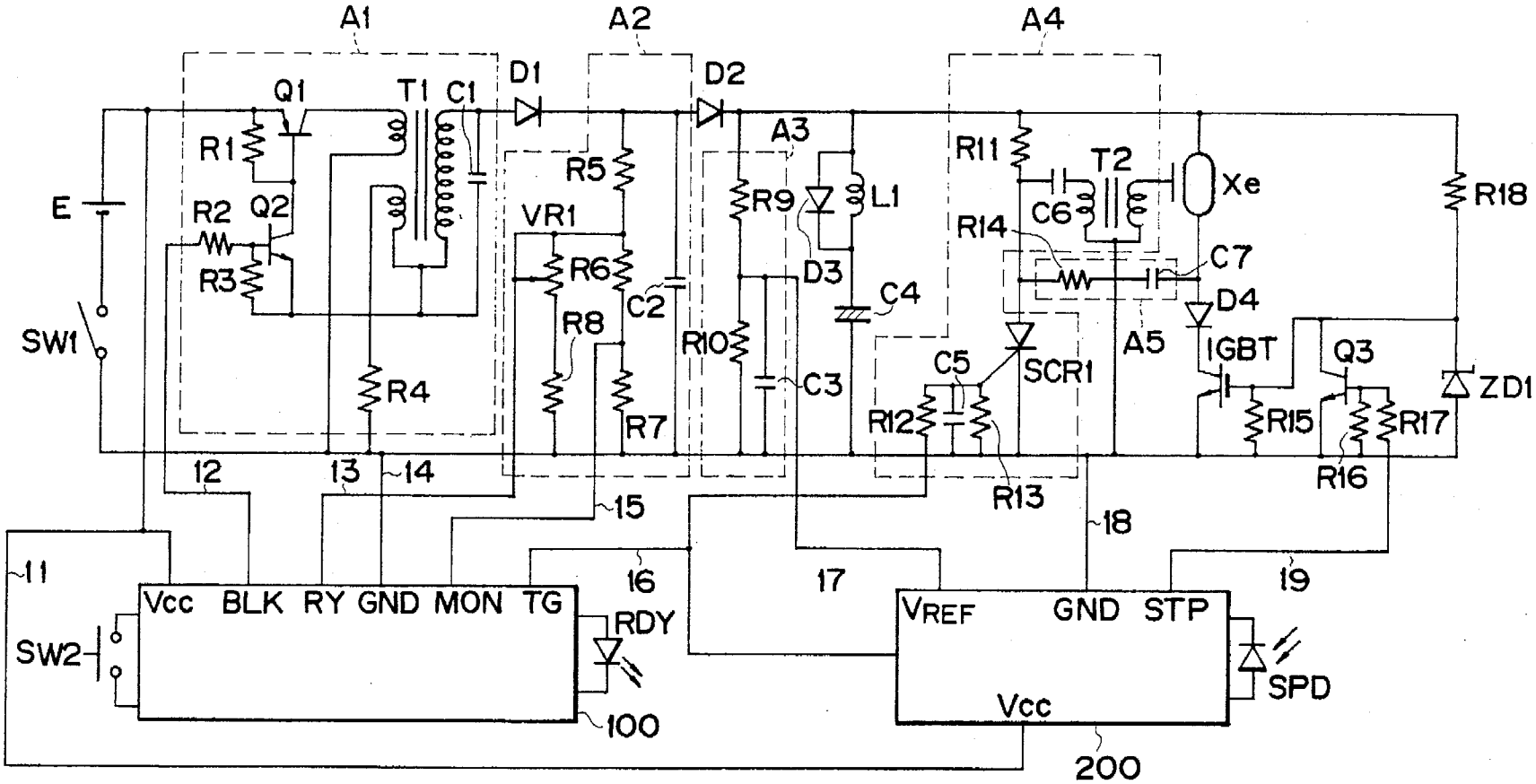
FIG. 1 is a circuit diagram showing a preferred embodiment of the electronic flash apparatus according to the present invention.
Figure 2:
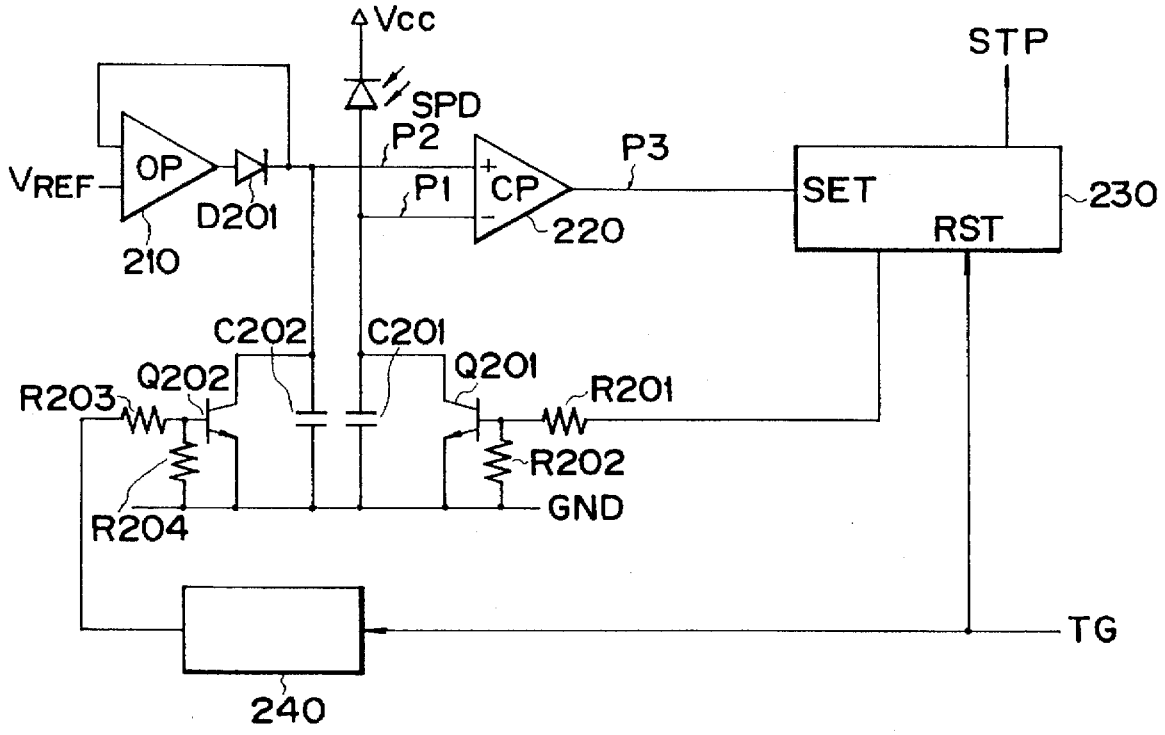
FIG. 2 is a circuit diagram showing an integrating circuit of the electronic flash apparatus according to the present invention.

FIG. 1 is a circuit diagram showing the embodiment of the electronic flash apparatus according to the present invention. FIG. 2 is a circuit diagram showing details of the integrating circuit 200 shown in FIG. 1.

In FIG. 1, a power source such as a cell is denoted by E and a power source switch by SW1. A booster circuit A1 consists of transistors Q1 and Q2, resistances R1 to R4, a booster transformer T1 and a condenser C1. A voltage detector circuit A2 consists of resistance R5 to R8, a variable resistance VR1 and a condenser C2. And a reference voltage generator circuit A3 for determining the luminous amount of each of the repeated flashes consists of resistances R9 and R10, and a condensor C3.

D1 to D3 denote diodes, L1 denotes a coil, and C4 denotes a main condenser for accumulating energy for flash operation. A trigger circuit A4 consists of resistances R11 to R13, condensers C5 and C6, a trigger transformer T2, and a thyristor SCR1. And a voltage doubler circuit A5 consists of a resistance R14 and a condensor C7.

A flash tube is denoted by Xe, a diode by D4, an insulated gate bipolar transistor for controlling flash operation of the flash tube by IGBT, resistances by R5 to R18, a Zener diode by ZD1, and a transistor by Q3.

A switch SW2 serving as a flash start switch and a ready light RDY for displaying the state of charging of the main condenser are connected with a control circuit 100. The control circuit 100 has: a VCC terminal to which electric power through a power source line 11 is applied; a BLK terminal for applying a boosting signal through a signal line to a terminal of the resistance R2 in the booster circuit A1; an RY terminal which is connected through a signal line 13 with a moving terminal of the variable resistance VR1 in the voltage detector circuit in order to detect the state of charging of the main condenser C4; a GND terminal connected through a line 14 with a power at the reference electric potential; a MON terminal which is connected through a signal line 15 with a connection between the resistances R6 and R7 in the voltage detector circuit A2 in order to detect the state of charging of the main condenser C4; and a TG terminal for outputting a flash start signal through a signal line 16 to the trigger circuit A4 and the integrating circuit 200 when the switch SW2 is turned on.

The integrating circuit 200 has: a VCC terminal to which electric power through the power source line 11 is applied; a GND terminal connected through a line 18 with a point at the referential electric potential; a VREF terminal which is connected through a line 17 to the connection between the resistances R9 and R10 in the reference voltage generator circuit A3 in order to input the luminous amount of each of the repeated flashes; and an STP terminal for outputting a signal through a line 19 in order to stop the flash operation when the flash tube Xe finishes the flash operation of a predetermined duration. Also, a photo detector SPD for monitoring the flash operation of the flash tube Xe is connected with the integrating circuit 200. The photo detector SPD is disposed in order to receive light which is transmitted from the flash tube and is not reflected by a field to be photographed.

The integrating circuit 200 has constitution shown in FIG. 2. More specifically, the integrating circuit 200 comprises: an operational amplifier 210; a comparator 220; a one-shot circuit 230 for outputting flash operation stop signals from the STP terminal during a predetermined period; and a one-shot circuit 240 for outputting a pulse signal after a predetermined lapse of time. The integrating circuit also includes the following elements: that is, a diode D201, a transistor Q201, a transistor Q202, a condenser C201, a condenser C202, and resistances R201 to R204. Note that the inverting input terminal of the comparator 220 is indicated as a point P1, the non-inverting input terminal thereof as a point P2 and the output terminal thereof as a point P3.

Next, the operations of the electronic flash apparatus having the above-mentioned constitution will be described.

When the power source switch SW1 is turned on, the control circuit 100 outputs a boosting signal from the BLK terminal and applies it to the booster circuit A1. The booster circuit A1 starts boosting operation when it receives said boosting signal, wherein the condenser is charged with electricity through the diode D1 and the main condenser C4 with electricity through the diode D2. And as the main condenser C4 is charged, voltage of the Zener diode ZD1 is applied through the resistance R18 to the gate of the insulated gate bipolar transistor IGBT, thereby conducting electricity between the collector and the emitter of the insulated gate bipolar transistor IGBT.

The trigger condenser C6 is charged with electricity through the resistance R11. The voltage of the main condenser is divided between the resistances R9 and R10. And the condenser C3 is charged with the voltage of the divided resistance of the resistance R10. And this divided voltage of the main condenser C4 is applied to the VREF terminal of the integrating circuit 200. And the condenser C7 is charged with electricity through the resistance R11, the resistance R14, the diode D4, and the collector and the emitter of the insulated gate bipolar transistor IGBT.

During the boosting operation, when the voltage accumulated in the main condenser C4 becomes greater than a first voltage set by the voltage detector circuit A2, the ready-light-ON signal is applied through the signal line 13 to the RY terminal to turn on the ready light RDY. When the booster operation is further advanced, the boosting operation stop signal is applied through the signal line 15 to the MON terminal to stop the boosting signal.

Note that the capacity of the condenser C2 is much smaller than that of the main condenser C4 and that the electric charge stored in the condenser C2 is discharged through the resistances R5 to R8 and the variable resistor VR1 immediately after the boosting operation is stopped. Accordingly, the control circuit 100 performs control so that the boosting signal ceases to be output from the BLK terminal when the boosting operation stop signal is received and resumes its output when the ready-light-ON signal is out.

The integrating circuit 200 in FIG. 2 applies the peak value of the divided voltage, which is obtained by dividing the voltage accumulated in the main condenser C4 and is applied to the VREF terminal, through the operational amplifier 210 to the condenser C202. Thus, the peak value of the divided voltage of the main condenser C4 is held in the condenser C202 as the reference voltage of the repetitive flash operation. The voltage at the point P2 whose peak value is held is determined so as to secure a predetermined duration of the repetitive flash operation of the electronic flash apparatus even if the main condenser C4 is not fully charged. The transistor Q201 connected with the point P1 is normally conductive and the point P1 is substantially equal to the ground electric potential. On the other hand, the transistor Q202 connected with the point P2 is normally non-conductive, so the point P3 is at "H" (high) level.

When the switch SW2 is turned on in the above state, the control circuit 100 outputs the flash operation start signal from the TG terminal and applies it through the resistance R12 to the gate of the thyristor SCR1 in the trigger circuit A4, which then applies the several thousand volt trigger voltage to the flash tube Xe. Thus, the flash operation of the flash tube Xe is started.

The flash operation start signal is also applied to the RST terminal of the one-shot circuit 230 in the integrating circuit 200 to make the transistor Q201 non-conductive. Then, the flashes from the flash tube Xe are monitored by the photo detector SPD and the electric charge obtained by integrating the quantity of light is stored in the condenser C201.

The comparator 220 inverts the voltage at the output terminal P3 into "L" (low) level when the voltage at the point P1, which is subjected to an integral of quantity of light, becomes greater than the voltage at the point P2 serving as the reference voltage. When a SET terminal is turned from "H" level to "L" level, the one-shot circuit 230 starts outputting the STP signal from the STP terminal and applies it to the base of the transistor Q3 for a predetermined period. This signal turns the transistor Q3 conductive, thereby substantially equalizing the gate potential of the insulated gate bipolar transistor IGBT to the ground electric potential. Accordingly, electricity cannot be conducted between the collector and the emitter of the insulated gate bipolar transistor IGBT and the flash tube Xe stops the flash operation. At the same time, the transistor Q201 is made to be conductive while the STP signal is output so that electricity stored in the condenser C201 is discharged.

As the thyristor SCR1 conducts electricity, the voltage doubler circuit A5 applies voltage which is about twice as large as that accumulated in the main condenser C4 to the flash tube Xe. When the one-shot circuit 230 stops outputting the STP signal, the flash tube Xe resumes the flash operation, the above-mentioned integral calculus is executed, and the repetitive flash operation is continued till the electricity stored in the main condenser C4 decreases below the level capable of performing the flash operation. In the preceding structure, the flash operation repeatedly operates during one exposure operation of a camera.

Incidentally, it is well known that the flash tube Xe, once excited, flashes for a certain period even if the trigger voltage is not applied. The one-shot circuit 240 starts clock operation when the flash operation start signal is applied, and outputs an output signal for turning the transistor Q2 conductive after a predetermined lapse of time. Thus, the electricity stored in the condenser C202 as the peak value of the voltage is discharged.

As described above, the value of the reference voltage is obtained from the value of the voltage accumulated in the main condenser C4, and the value obtained from the integral calculus of quantity of light of the flashes of the flash tube Xe is compared with said value of the reference voltage. And when the value of the integral of quantity of light becomes greater than the value of the reference voltage, the flash tube Xe stops the flash operation. Accordingly, the repetitive flash operation according to the voltage accumulated in the main condenser C4 can be efficiently maintained during a predetermined duration of the flash operation.

As described above, since the electronic flash apparatus according to the present invention can vary the luminous amount of each of the repeated flashes according to the voltage accumulated in the condenser, the repetitive flash operation according to the voltage accumulated in the condenser can be efficiently maintained during the predetermined duration of the flash operation.

What is claimed is:

1. An electronic flash apparatus comprising:

a capacitor;

a flash tube which is connected with said capacitor and flashes when electricity stored in said capacitor is discharged; and a flash operation control device for performing drive control of said flash tube so that the flash tube flashes repeatedly when electricity stored in said capacitor is applied to the flash tube, wherein said flash operation control device has: a reference voltage generator device for generating a value of the reference voltage from the value of the voltage accumulated in said capacitor; a light quantity integrating device for obtaining the integrated value of quantity of light of the flash emitted from said flash tube; and a comparison device for comparing the output value of said reference voltage generator device with the output value of said light quantity integrating device, and wherein said flash operation control device adjusts the flash operation of said flash tube if the integrated value of the luminous amount of the flash emitted from the flash tube is judged to become greater than the value of the reference voltage generated from the value of the voltage accumulated in said capacitor.

2. An electronic flash apparatus comprising:

a charge storage device storing a charge for a repetitive flash operation;

a flash connected with said charge storage device;

a reference charge generator generating a reference charge based on dividing said stored charge of said charge storage device;

a flash intensity determining device determining an integrated flash intensity charge representing an integrated value of a quantity of light of flashes emitted during the repetitive flash operation; and a flash adjusting device adjusting the flash emitted during the respective flash operation when the integrated flash intensity charge is greater than said reference charge.

3. A method for flashing an electronic flash comprising the steps of:

storing a charge;

generating a reference charge by dividing the stored charge;

applying the stored charge to the flash;

determining an integrated flash intensity charge representing an integrated value of a quantity of light of flashes emitted during a repetitive flash operation; and, adjusting the luminous amount of each of the repeated flashes when the integrated flash intensity charge is greater than the reference charge.

* * * * *